United States Patent [19]

Ballard

[11] 4,191,163

[45] Mar. 4, 1980

[54] FIREPLACE WATER HEATER

[76] Inventor: Henry G. Ballard, Rt. 9, Box 151, Easley, S.C. 29640

[21] Appl. No.: 875,387

[22] Filed: Feb. 6, 1978

[51] Int. Cl.[2] ..... F24B 9/04

[52] U.S. Cl. ..... 126/132

[58] Field of Search ..... 126/132, 121; 237/8 R, 237/19

[56] References Cited

U.S. PATENT DOCUMENTS

| | | | |
|---|---|---|---|
| 219,978 | 9/1979 | Rice | 126/132 |
| 495,418 | 4/1893 | Lewis | 126/132 |
| 551,651 | 12/1895 | Robinson | 126/132 |
| 670,066 | 3/1901 | Smoak | 126/132 |
| 677,542 | 7/1901 | Heitland | 126/132 |
| 3,958,755 | 5/1976 | Cleer, Jr. | 126/132 |
| 4,025,043 | 5/1977 | Cleer, Jr. | 126/132 |

FOREIGN PATENT DOCUMENTS

| | | | |
|---|---|---|---|
| 183625 | 4/1936 | Switzerland | 126/132 |
| 3416 | of 1910 | United Kingdom | 126/132 |
| 159234 | 5/1921 | United Kingdom | 126/132 |
| 179683 | 5/1922 | United Kingdom | 126/132 |
| 241712 | 10/1925 | United Kingdom | 126/132 |

*Primary Examiner*—Samuel Scott
*Assistant Examiner*—Randall L. Green
*Attorney, Agent, or Firm*—Bailey, Dority & Flint

[57] ABSTRACT

A fireplace water heater is illustrated which employs tubular members for the purpose of forming a pressure vessel affording maximized surface for receiving heat from a fireplace and heating water contemplating the use of a lower header which may be in elevated position above the hearth so that the logs or other fuel are not in direct contact therewith facilitating the burning of the fire.

2 Claims, 4 Drawing Figures

Fig. 1.
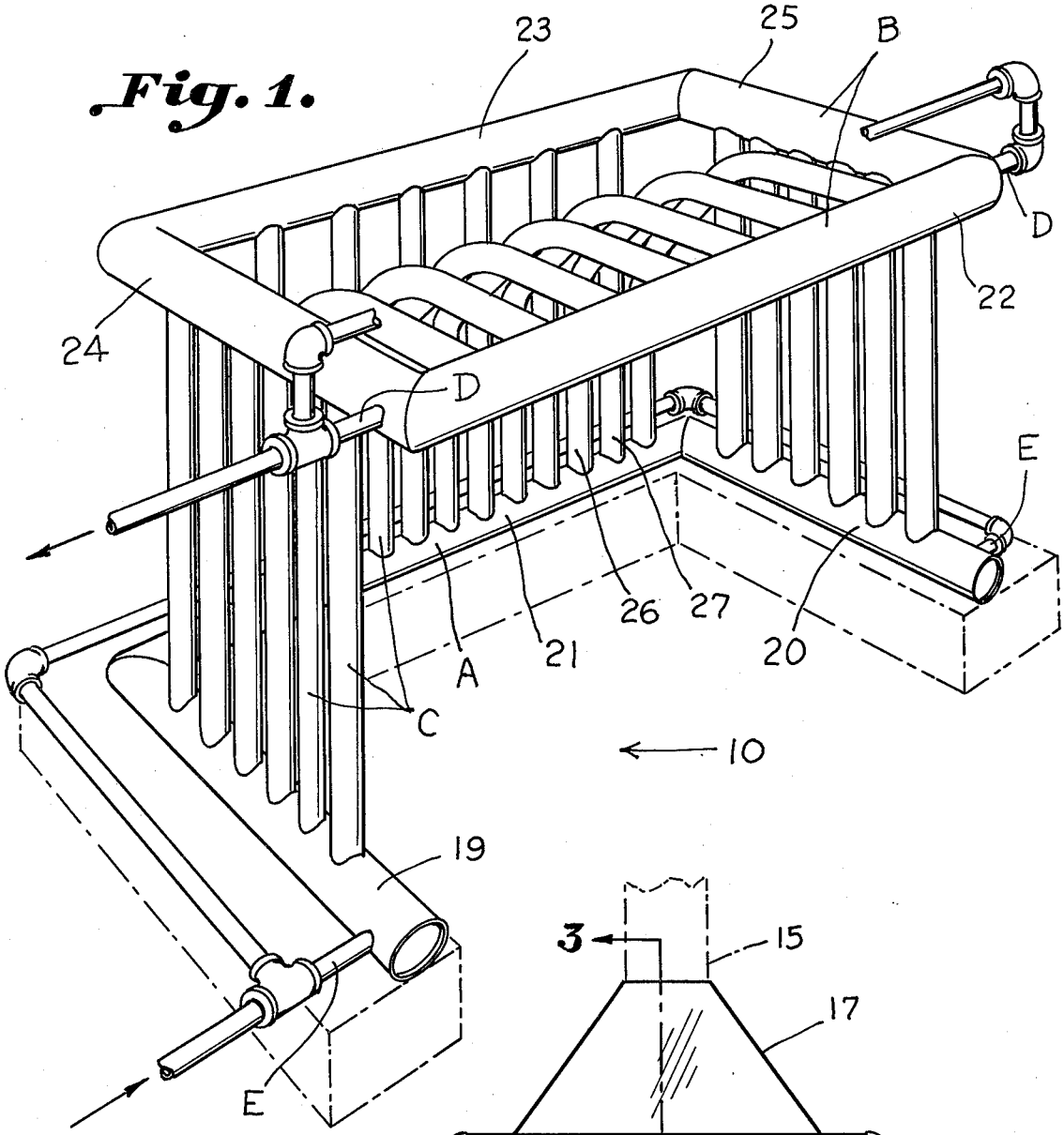
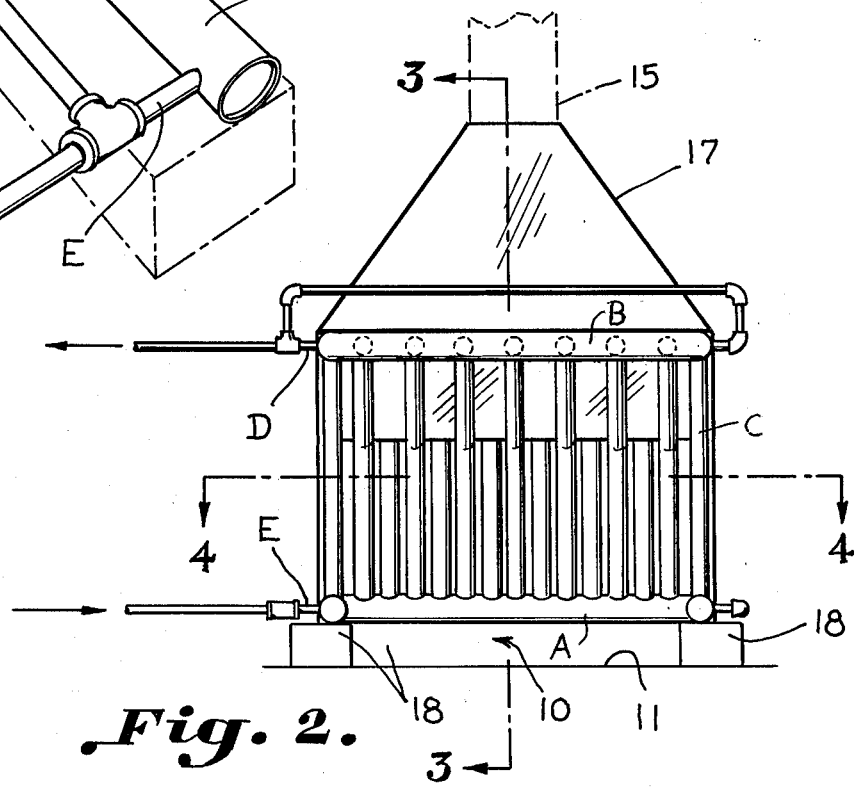
Fig. 2.

FIREPLACE WATER HEATER

BACKGROUND OF THE INVENTION

A number of water heater fireplace arrangements have been contemplated in the past, the most pertinent appearing to be that described in U.S. Pat. No. 219,978. In this patent a coil is employed in connection with a water tank for heating water in a fireplace. More recently U.S. Pat. Nos. 3,958,755 and 4,025,043 illustrate the use of encasing tanks which define the fire chamber of the fireplace and employ tubular members as a grate on which the fire may be built. When tubular members are used as a grate, it has been found difficult to build and maintain the burning of the fire since heat is removed so quickly to prevent continued burning. The hearth of the present invention is open entirely about the central portion thereof to accommodate conventional and any desired andirons or any other support for the logs and the like. The heaters of the prior art present a limited surface area for contact with the heat and the tanks defined by the casings are incapable of withstanding pressure unless inordinately heavy construction materials are utilized. The fireplace of the present invention may be used in connection with the systems illustrated in the prior art patents referred to above.

BRIEF DESCRIPTION OF THE INVENTION

It has been found that an effective fireplace water heater may be constructed utilizing tubular upper and lower headers connected by upright tubular members so as to provide an open hearth area for building the fire and a maximum of surface area for receiving heat which may withstand pressures generated as a result of heating the water to an elevated temperature and forming steam.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 1 is a perspective view illustrating a fireplace water heater constructed in accordance with the present invention, FIG. 2 is a front elevation further illustrating the fireplace water heater illustrated in FIG. 1.

DESCRIPTION OF A PREFERRED EMBODIMENT

Figure 3:
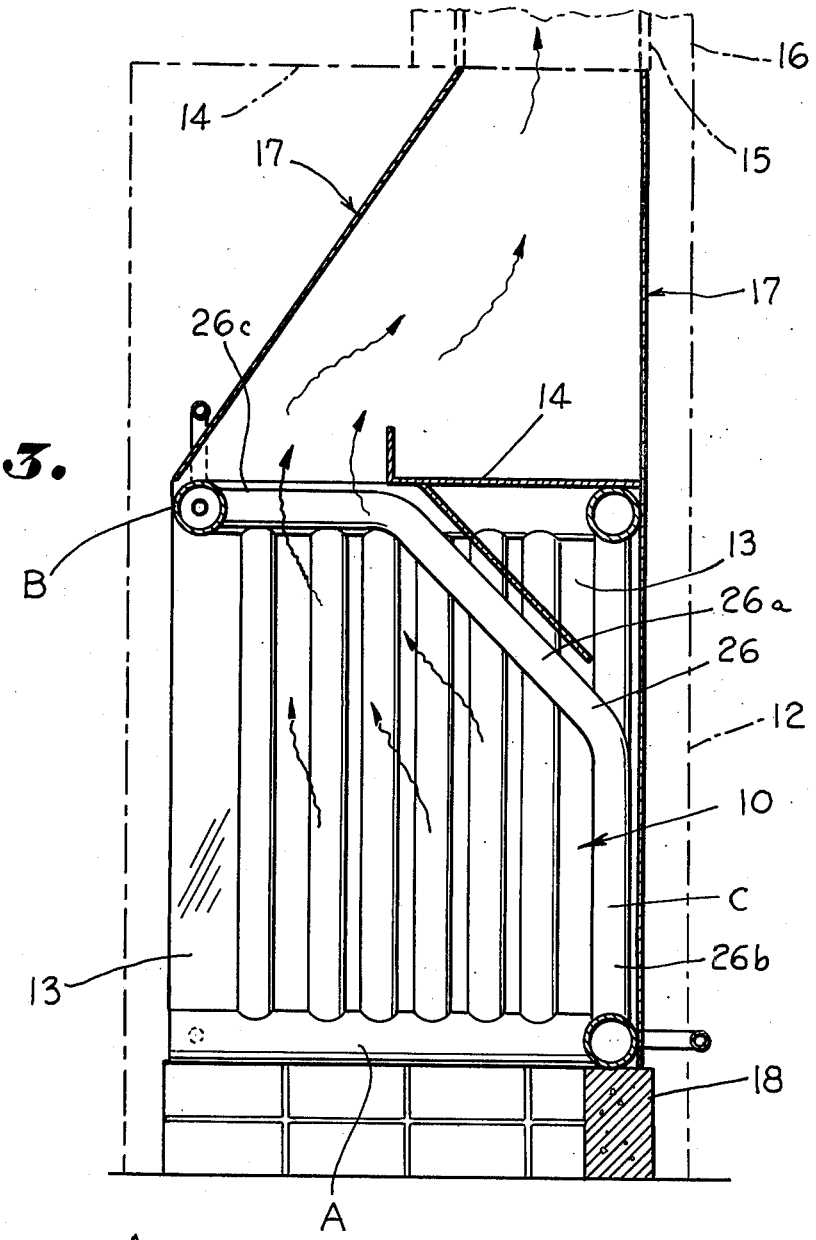
FIG. 3 is a transverse sectional elevation taken on the line 3—3 in FIG. 2.
Figure 4:
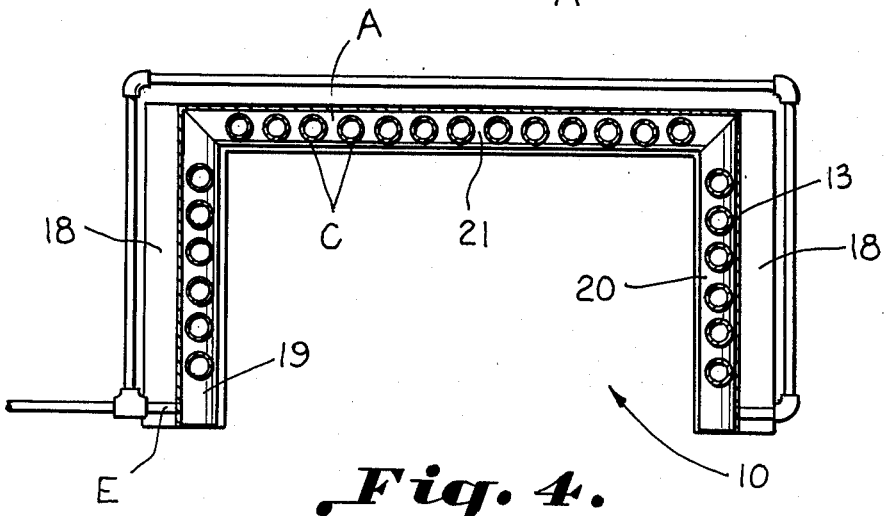
FIG. 4 is a sectional plan view taken on the line 4—4 in FIG. 2.

The drawings illustrate a fireplace having a fire chamber defined by a hearth, rear and side walls, and a top wall containing a flue for connection to a chimney. A water heater therefor includes a lower header A extending adjacent the rear and side walls within the fire chamber defining an open area for building a fire. An upper header B extends adjacent a marginal portion of the top wall and about the flue. A plurality of spaced upright boiler pipes C connect the lower and upper headers. Connections D and E are for supplying water to flow through said water heater.

The fireplce includes a fire chamber broadly designated at 10 which is defined in part by a hearth 11, a rear wall 12, side walls 13, and a top wall 14 containing a flue 15. The flue provides a suitable connection to the chimney 16. The rear wall 12, side walls 13, and top wall 14 are ligned by a suitable housing or shield, broadly designated at 17.

It is important to note that a marginal base portion 18 surrounds the hearth adjacent the rear and side walls to provide a built up support for the water heater described herein.

More particularly, the water heater constitutes a pressure vessel which is constructed of tubular elements, pipes and conduits of suitable construction for withstanding pressure as when the water is heated to elevated temperatures.

The lower header A includes conduits 19 and 20, each of which is closed on one end but communicates with a rear conduit 21 at right angles thereto. The upper header B includes front and rear conduit portions 22 and 23, respectively, which are connected for water flow therebetween by conduits 24 and 25 adjacent the side walls of the fireplace. It will be observed that the upright boiler pipes C include alternate pipes 26 which have a rearwardly inclined intermediate portion **26*a* which connects a lower substantially vertical portion 26*b* and an upper horizontal portion 26*c*. The remaining upright pipes C are illustrated as being substantially vertical connecting pipes 27. All the upright pipes 26 and 27** communicate for carrying water between the lower and upper headers A and B.

It will thus be noted that the upright pipes C together with the upper and lower headers, present a large surface area for contact with the heat generated in the fire chamber. The upright pipes 26 which are inclined at an upper portion thereof across the fire chamber add to the efficiency of the water heater receiving heat from the fire when burning in the fireplace for heating water.

It is contemplated that the fireplace water heater hereof may be utilized in connection with standard glass fire screens and any other desirable auxiliary equipment. Since an open area is presented on the hearth wherein the logs, coal or other fuel is maintained out of direct contact with the water heater, it is relatively easy to build and maintain fires in the fire chamber.

While it is contemplated that the fireplace water heater may be utilized to convey water to heaters of any desired form, such as radiators or pipes within floor slabs or other construction, it may also be used in generation of hot water supplies for at home and the like. More importantly, the fireplace heater described herein is capable of withstanding elevated pressures and can be used in more sophisticated systems such as solar heating systems on cloudy or extremely cold days.

While a preferred embodiment of the invention has been described using specific terms, such description is for illustrative purposes only, and it is to be understood that changes and variations may be made without departing from the spirit and scope of the following claims.

What is claimed is:

1. A water heater for a fireplace having a fire chamber defined by a hearth, rear and side walls, and a top wall containing a flue comprising:

a lower U-shaped header consisting of heater pipes extending adjacent respective rear and side walls within said fire chamber defining an open area for building a fire so that the hearth is entirely open about a central portion thereof to accommodate a fire supported therein entirely apart from the heater;

an upper heater extending adjacent a marginal portion of said top wall about the flue;

a plurality of upright boiler pipes connecting said lower and upper headers spaced along said rear and side walls;

a first number of said boiler pipes along said rear wall extending substantially vertically upwardly from said lower header connecting with a rear portion of said upper header and a second number of said boiler pipes alternating with said first number extending diagonally across said fire chamber connecting with a front portion of said upper head simultaneously communicating water flow from said lower header with said front and rear portions of said upper header enhancing efficient transfer of heat; and connections for supplying water to flow through said water heater.

2. The structure set forth in claim 1 wherein said upper header is substantially horizontal and extends entirely about said flue.

* * * * *